US009739453B2

(12) United States Patent
Yang et al.

(10) Patent No.: US 9,739,453 B2
(45) Date of Patent: Aug. 22, 2017

(54) APPARATUS AND METHOD FOR ADJUSTING SCREEN LUMINANCE OF SPLICED DISPLAY DEVICE

(71) Applicant: BOE TECHNOLOGY GROUP CO., LTD., Beijing (CN)

(72) Inventors: Fan Yang, Beijing (CN); Xiao Zhang, Beijing (CN)

(73) Assignee: BOE TECHNOLOGY GROUP CO., LTD. (CN)

( * ) Notice: Subject to any disclaimer, the term of this patent is extended or adjusted under 35 U.S.C. 154(b) by 0 days.

(21) Appl. No.: 15/073,279

(22) Filed: Mar. 17, 2016

(65) Prior Publication Data

US 2016/0363292 A1 Dec. 15, 2016

(30) Foreign Application Priority Data

Jun. 12, 2015 (CN) ..... 2015 1 0324717

(51) Int. Cl.

| | |
|---|---|
| ***G09F 13/04*** | (2006.01) |
| ***G09F 13/08*** | (2006.01) |
| ***F21V 14/02*** | (2006.01) |
| ***F21V 21/15*** | (2006.01) |
| ***F21V 21/26*** | (2006.01) |
| ***G09G 3/34*** | (2006.01) |
| *F21Y 103/00* | (2016.01) |

(52) U.S. Cl.

CPC ..... *F21V 14/02* (2013.01); *F21V 21/15* (2013.01); *F21V 21/26* (2013.01); *G09G 3/3406* (2013.01); *F21Y 2103/003* (2013.01); *G09G 2320/0233* (2013.01)

(58) Field of Classification Search

USPC ..... 362/97.1

See application file for complete search history.

(56) References Cited

U.S. PATENT DOCUMENTS

| | | | | |
|---|---|---|---|---|
| 4,898,463 | A * | 2/1990 | Sakamoto | G01M 11/3145 356/73.1 |
| 5,611,015 | A * | 3/1997 | Tokumaru | G01M 11/088 385/98 |
| 2002/0159724 | A1* | 10/2002 | Oki | G02B 6/2551 385/97 |
| 2013/0010013 | A1* | 1/2013 | Li | G03B 21/56 345/690 |

(Continued)

*Primary Examiner* — Tuyen K Vo

(74) *Attorney, Agent, or Firm* — Brooks Kushman P.C.

(57) ABSTRACT

According to embodiments of the present disclosure, an apparatus for adjusting the luminance of a screen of a spliced display device may include: an adjustment module configured to control rotation of a light-emitting unit within a backlight module in the spliced display device within a range; a collection module configured to collect a plurality of pieces of luminance information of a spliced screen of the spliced display device when the light-emitting unit is rotated at various angles; and a processing module configured to calculate a ratio between a minimum luminance value and a maximum luminance value for each piece of the luminance information, determine a maximum value among a plurality of the ratios and a specific angle of rotation of the light-emitting unit corresponding to the luminance information having the maximum value, and rotate the light-emitting unit at the specific angle of rotation by controlling the adjustment module.

20 Claims, 2 Drawing Sheets

(56) References Cited

U.S. PATENT DOCUMENTS

2014/0022485 A1* 1/2014 Kuo ..... G02F 1/133308
349/58
2014/0198251 A1* 7/2014 Li ..... H04N 11/20
348/453

* cited by examiner

APPARATUS AND METHOD FOR ADJUSTING SCREEN LUMINANCE OF SPLICED DISPLAY DEVICE

CROSS-REFERENCE TO RELATED APPLICATIONS

This application claims priority to Chinese Patent Application No. 201510324717.6 filed on Jun. 12, 2015 in China, which is herein incorporated by reference in its entirety.

TECHNICAL FIELD

The present disclosure relates to the field of display technology, and particularly to an apparatus and method for adjusting the luminance of a screen of a spliced display device.

BACKGROUND

A spliced screen of a spliced display device is generally formed by splicing a plurality of small-screens. Generally, this technology is used for a super large screen display for displaying a picture and a multi-window display for displaying a plurality of pictures. A backlight module of the spliced display device is generally constituted by a plurality of light emitting diode (LED) light bars. The plurality of LED light bars is distributed around the spliced screen, and provides light for the spliced screen from sides of the spliced screen.

Currently, as the increasing size of the spliced screen, which causes uniformity of the luminance of a screen of the spliced display device to deteriorate, there is often a dark side and dark corner phenomenon when the screen is displaying. When the dark side and dark corner phenomenon is quite obvious, the display effect of the screen will be adversely affected.

SUMMARY

The present disclosure provides an apparatus and a method for adjusting the luminance of a screen of a spliced display device to improve uniformity of the luminance of the screen of the spliced display device.

To achieve the above object, embodiments of the present disclosure provide the following technical solutions.

According to a first aspect of the present disclosure, there is provided an apparatus for adjusting the luminance of a screen of a spliced display device, and the apparatus may include:

an adjustment module configured to control rotation of a light-emitting unit within a backlight module in the spliced display device within a range;

a collection module configured to collect a plurality of pieces of luminance information of a spliced screen of the spliced display device when the light-emitting unit is rotated at various angles; and a processing module configured to calculate a ratio between a minimum luminance value and a maximum luminance value for each piece of the luminance information, determine a maximum value among a plurality of the ratios and a specific angle of rotation of the light-emitting unit corresponding to the luminance information having the maximum value, and rotate the light-emitting unit at the specific angle of rotation by controlling the adjustment module.

According to an alternative embodiment, the collection module may be a camera.

According to an alternative embodiment, the camera may be a charge-coupled device (CCD) camera.

According to an alternative embodiment, the camera may be an infrared camera.

According to an alternative embodiment, an angle between an optical axis of the camera and the spliced screen may range from −60 degrees to 60 degrees.

According to an alternative embodiment, the processing module may include:

a calculating module configured to calculate a ratio between a minimum luminance value and a maximum luminance value for each piece of the luminance information, determine the maximum value among a plurality of the ratios and a specific angle of rotation of the light-emitting unit corresponding to the luminance information having the maximum value, and output a signal for the specific angle of rotation; and a controlling module in communication with the calculating module and configured to control the adjustment module to rotate the light-emitting unit at the specific angle of rotation according to the received signal for the specific angle of rotation.

According to an alternative embodiment, the adjustment module may include:

a stepper motor in communication with the processing module; and a moving unit connected with the stepper motor in a mechanical transmission way.

According to an alternative embodiment, the moving unit may be a mechanical arm.

According to an alternative embodiment, the light-emitting unit may include a plurality of light emitting diode (LED) light bars located on each side of the spliced screen.

According to an alternative embodiment, the backlight module may further include a frame for mounting the plurality of LED light bars: wherein the frame has a fixed surface for mounting the plurality of LED light bars; and wherein the angle of rotation of the light-emitting unit is an angle of the light bars with respect to the fixed surface on which the light bars are located.

According to an alternative embodiment, each of the LED light bars may be pivotally mounted onto the fixed surface by a rotary shaft.

According to a second aspect of the present disclosure, there is provided a method for adjusting the luminance of a screen of a spliced display device which comprises a backlight module, and the method may include:

controlling rotation of a light-emitting unit within a backlight module in the spliced display device within a range;

collecting a plurality of pieces of luminance information of a spliced screen of the spliced display device when the light-emitting unit is rotated at various angles; and calculating a ratio between a minimum luminance value and a maximum luminance value for each piece of the luminance information, determining a maximum value among a plurality of the ratios and a specific angle of rotation of the light-emitting unit corresponding to the luminance information having the maximum value, and rotating the light-emitting unit at a specific angle of rotation.

According to an alternative embodiment, the luminance information of the spliced screen may be collected by a camera.

According to an alternative embodiment, the camera may be a charge-coupled device (CCD) camera.

According to an alternative embodiment, the camera may be an infrared camera.

According to an alternative embodiment, an angle between an optical axis of the camera and the spliced screen may range from −60 degrees to 60 degrees.

According to an alternative embodiment, the calculating step may include:

calculating a ratio between a minimum luminance value and a maximum luminance value for each piece of the luminance information, determining the maximum value among a plurality of the ratios and a specific angle of rotation of the light-emitting unit corresponding to the luminance information having the maximum value, and outputting a signal for the specific angle of rotation; and rotating the light-emitting unit at the specific angle of rotation according to the received signal for the specific angle of rotation.

According to an alternative embodiment, the controlling step may include:

controlling, by a stepper motor and a moving unit connected with the stepper motor in a mechanical transmission way, the light-emitting unit within the backlight module in the spliced display device to rotate within the range.

According to an alternative embodiment, the light-emitting unit within the backlight module in the spliced display device may be controlled to rotate within the range by the stepper motor and a mechanical arm connected with the stepper motor in a mechanical transmission way.

According to an alternative embodiment, the light-emitting unit may include a plurality of light emitting diode (LED) light bars located on each side of the spliced screen.

According to an alternative embodiment, the backlight module may further include a frame for mounting the plurality of LED light bars; wherein the frame has a fixed surface for mounting the plurality of LED light bars; and wherein the angle of rotation of the light-emitting unit is an angle of the light bars with respect to the fixed surface on which the light bars are located.

According to an alternative embodiment, each of the LED light bars may be pivotally mounted onto the fixed surface by a rotary shaft.

With the apparatus and the method for adjusting the luminance of a screen of a spliced display device according to the present disclosure, the light-emitting unit may be controlled to rotate within a range by the adjustment module; a plurality of pieces of luminance information of a spliced screen collected by the collection module would be different as the light-emitting unit is at different locations; and the processing module calculates a ratio between a minimum luminance value and a maximum luminance value for each piece of the luminance information, and determines a maximum value among a plurality of the ratios and a specific angle of rotation of the light-emitting unit corresponding to the luminance information having the maximum value, and rotates the light-emitting unit at the specific angle of rotation by controlling the adjustment module. Thus a difference between a brightest value and a darkest value of the screen of the spliced display device can be reduced to some extent, and therefore uniformity of the luminance of the screen of the spliced display device can be further improved.

BRIEF DESCRIPTION OF THE DRAWINGS

The drawings to be used in the description of the embodiments are described briefly as follows, so that the technical solutions according to the embodiments of the present disclosure or according to the conventional technology become clearer. It is apparent that the drawings in the following description only illustrate some embodiments of the present disclosure. For those skilled in the art, other drawings may be obtained according to these drawings without any creative work.

| EXPLANATION OF REFERENCE SIGNS: | |
|---|---|
| 1- adjustment module | 11- stepper motor |
| 12 - moving unit | 2 - collection module |
| 3 - processing module | 31- calculation module |
| 32 - control module | 4 - light-emitting unit |
| 5 - spliced screen | 6 - frame |
| 61- fixed surface | |

DETAILED DESCRIPTION

Specific embodiments of the present invention will be further described below in conjunction with the accompanying drawings and embodiments. The following embodiments are illustrative only of the present invention, but are not intended to limit the scope of the present invention.

In order to make the objects, the technical solutions and the advantages of the present invention more apparent, the present invention will be described hereinafter in a clear and complete manner in conjunction with the drawings and embodiments. Obviously, the described embodiments are a part of embodiments of the present invention, but not all embodiments. All other embodiments obtained by those skilled in the art based on the disclosed embodiments of the present invention should fall into the scope of protection of the invention.

Unless otherwise defined, any technical or scientific terms used herein shall have the common meaning understood by a person of ordinary skills. Such words as "first" and "second" used in the specification and claims of the present invention are merely used to differentiate different components rather than to represent any order, number or importance. Similarly, such words as "one" or "one of" are merely used to represent the existence of at least one member, rather than to limit the number thereof. Such words as "connect" or "connected to" may include electrical connection, direct or indirect, rather than being limited to physical or mechanical connection. Such words as "on/above", "under/below", "left" and "right" are merely used to represent relative position relationship, and when an absolute position of an object is changed, the relative position relationship will be changed too.

A clear and complete description of technical solutions of the embodiments of the present disclosure will be made below in conjunction with embodiments of the present disclosure with reference to the accompanying drawings. Obviously, the described embodiments are only a part of embodiments of the present disclosure, but not all embodiments. Any other embodiments obtained by those skilled in the art based on the embodiments in the present disclosure without any creative work fall into the scope of the present disclosure.

Figure 1:
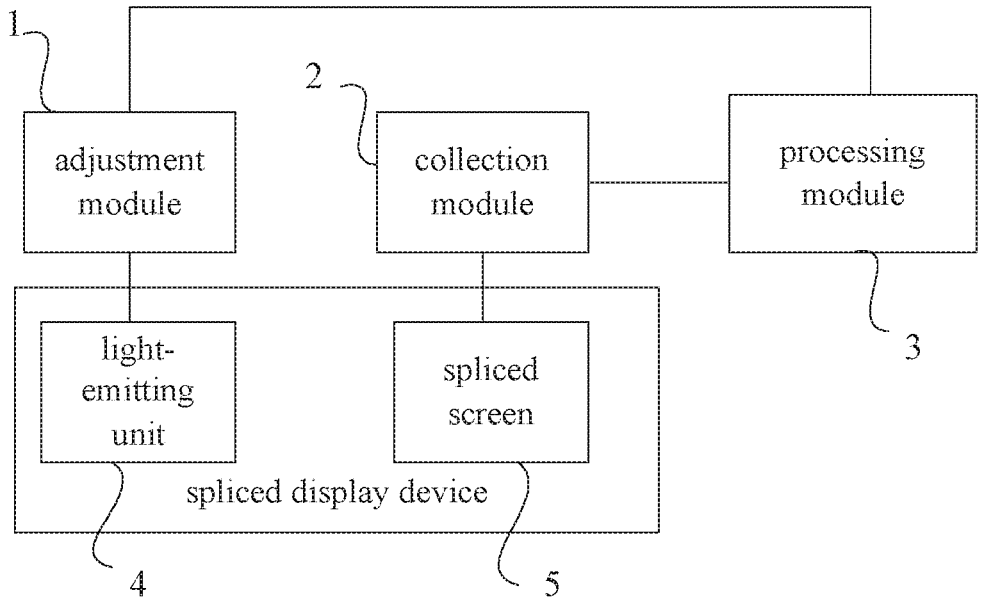
FIG. 1 is a structure schematic view of an apparatus for adjusting the luminance of a screen of a spliced display device according to an embodiment of the present disclosure.

As shown in FIG. 1, which is a structural schematic view of an apparatus for adjusting the luminance of a screen of a spliced display device according to an embodiment of the present disclosure, the apparatus for adjusting the luminance of the screen of the spliced display device according to the embodiment of the present disclosure includes:

an adjustment module 1 configured to control rotation of a light-emitting unit 4 within a backlight module in the spliced display device within a range;

a collection module 2 configured to collect a plurality of pieces of luminance information of a spliced screen 5 of the spliced display device when the light-emitting unit 4 is rotated at various angles; and a processing module 3 configured to calculate a ratio between a minimum luminance value and a maximum luminance value for each piece of the luminance information, determine a maximum value among a plurality of the ratios and a specific angle of rotation of the light-emitting unit 4 corresponding to the luminance information having the maximum value, and rotate the light-emitting unit 4 at a specific angle of rotation by controlling the adjustment module 1.

With the apparatus for adjusting the luminance of the screen of the spliced display device according to the embodiment of the present disclosure, the light-emitting unit 4 may be controlled to rotate within a range by the adjustment module 1; a plurality of pieces of luminance information of a spliced screen 5 collected by the collection module 2 would be different as the light-emitting unit 4 is at different locations; and the processing module 3 calculates a ratio between a minimum luminance value and a maximum luminance value for each piece of the luminance information, and determines a maximum value among a plurality of the ratios and a specific angle of rotation of the light-emitting unit 4 corresponding to the luminance information having the maximum value, and rotates the light-emitting unit 4 at the specific angle of rotation by controlling the adjustment module 1. Thus a difference between a brightest value and a darkest value of the screen of the spliced display device can be reduced, and therefore uniformity of the luminance of the screen of the spliced display device can be further improved.

The collection module described above may be a camera, and an angle between an optical axis of the camera and the spliced screen ranges from −60 degrees to 60 degrees. The camera arranged in this way may collect a plurality of pieces of luminance information of the entire spliced screen. The camera may be a charge-coupled device (CCD) camera. The CCD is a semiconductor device, which can convert an optical image into a digital signal. In addition, the camera may also be an infrared camera. Here, those skilled in the art will appreciate that the present disclosure does not make any restrictions on the type of the camera. Any type of well-known conventional imaging devices may be employed, as long as collection of the luminance information of the spliced screen of the spliced display device can be achieved.

Figure 2:
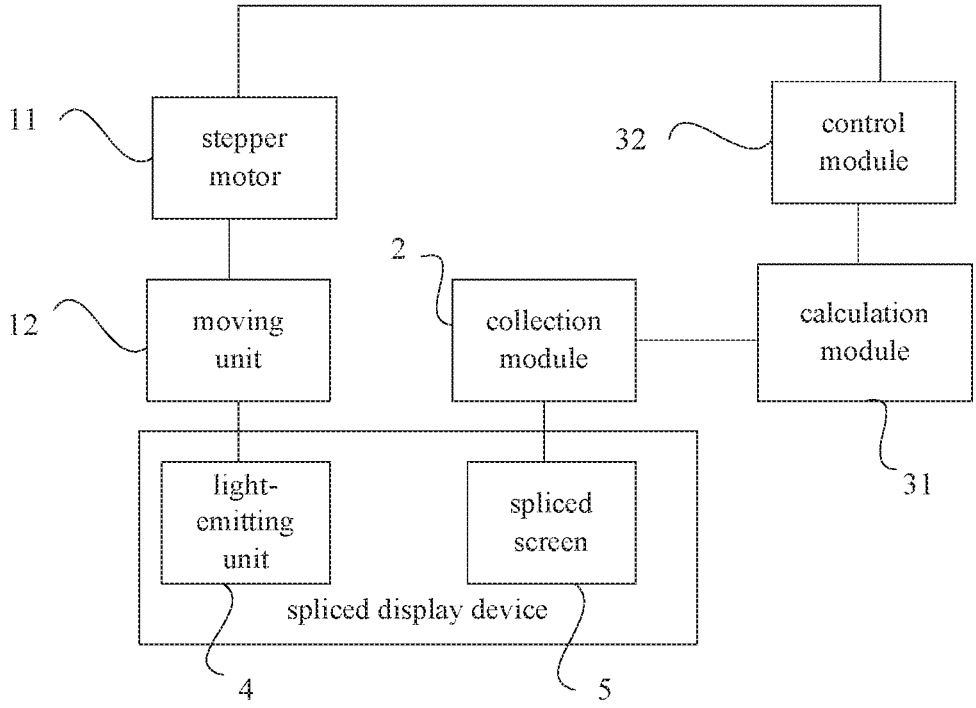
FIG. 2 is another structure schematic view of the apparatus for adjusting the luminance of the screen of the spliced display device according to the embodiment of the present disclosure.

Further, as shown in FIG. 2, FIG. 2 is another structure schematic view of the apparatus for adjusting the luminance of the screen of the spliced display device according to the embodiment of the present disclosure. The processing module 3 described above includes:

a calculating module 31 configured to calculate a ratio between a minimum luminance value and a maximum luminance value for each piece of the luminance information, determine the maximum value among a plurality of the ratios and a specific angle of rotation of the light-emitting unit corresponding to the luminance information having the maximum value, and output a signal for the specific angle of rotation; and a controlling module 32 in communication with the calculating module 31 and configured to control the adjustment module 1 to rotate the light-emitting unit 4 at the specific angle of rotation according to the received signal for the specific angle of rotation.

Further, the adjustment module 1 includes:

a stepper motor 11 in communication with the processing module 3; and a moving unit 12 connected with the stepper motor 11 in a mechanical transmission way. The stepper motor 11 moves according to the received signal and thereby controlling the moving unit 12 to enable the light-emitting unit 4 to rotate. The moving unit 12 described above is a mechanical arm or other mechanisms.

In a specific embodiment, the light-emitting unit 4 described above includes a plurality of light emitting diode (LED) light bars located on each side of the spliced screen. Here, those skilled in the art will appreciate that the present disclosure does not impose any restrictions on the number of the LED light bars.

Figure 3:
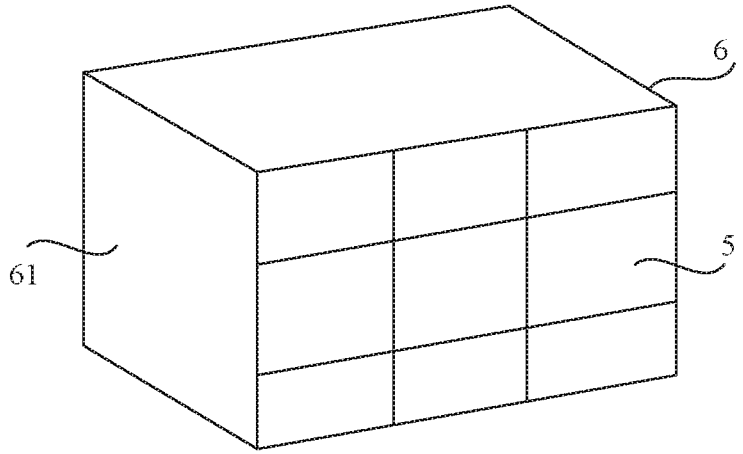
FIG. 3 is a partial structure diagram of the spliced display device according to another embodiment of the present disclosure.

As shown in FIG. 3, FIG. 3 is a partial structure diagram of the spliced display device according to another embodiment of the present disclosure. The backlight module further includes a frame 6 for mounting the plurality of LED light bars. The frame 6 has a fixed surface 61 for mounting the plurality of LED light bars. The angle of rotation of the light-emitting unit 4 is an angle of the light bars with respect to the fixed surface 61 on which the light bars are mounted. When the adjustment module performs adjustments, a plurality of LED light bars may be adjusted at the same time, and the plurality of LED light bars may also be adjusted separately one by one or several LED light bars be adjusted together.

In addition, with respect to the shape or manufacturing material of the frame 6 for mounting the plurality of LED light bars, those skilled in the art will appreciate that the present disclosure does not make any restrictions on these ones, and those skilled in the art can make a reasonable selection to achieve a better effect.

Optionally, each of the LED light bars is pivotally mounted onto the fixed surface by a rotary shaft. In order to facilitate adjustment of an angle of the LED light bars, an angle of rotation of the rotary axis may be directly controlled when achieving adjustment to achieve adjustment of the angle of the LED light bars.

Figure 4:
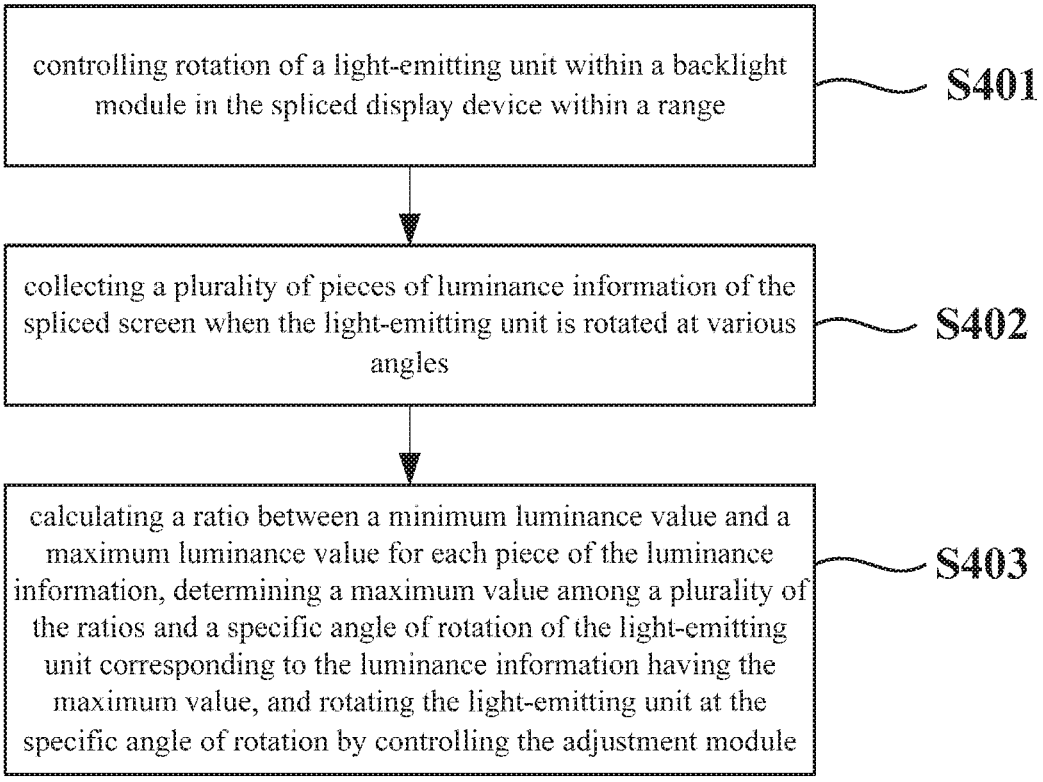
FIG. 4 is a flow chart of a method for adjusting the luminance of a screen of a spliced display device according to yet another embodiment of the present disclosure.

As shown in FIG. 4, FIG. 4 is a flow chart of a method for adjusting the luminance of a screen of a spliced display device according to still another embodiment of the present disclosure. According to the embodiment of the present disclosure, there is further provided a method for adjusting the luminance of a screen of a spliced display device which is applied on the above apparatus, and the method includes:

In step S401, rotation of a light-emitting unit within a backlight module in the spliced display device may be controlled within a range.

In step S402, a plurality of pieces of luminance information of the spliced screen may be collected when the light-emitting unit be rotated at various angles.

In step S403, a ratio between a minimum luminance value and a maximum luminance value for each piece of the luminance information may be calculated, a maximum value among a plurality of the ratios and a specific angle of rotation of the light-emitting unit corresponding to the luminance information having the maximum value may be determined, and the light-emitting unit may be rotated at the specific angle of rotation by controlling the adjustment module.

Further, other aspects of the method for adjusting the luminance of the screen of the spliced display device according to the present disclosure as described above may be referred to the apparatus for adjusting the luminance of the screen of the spliced display device as described above, and thus need not be repeated here.

Obviously, those skilled in the art can make various modifications and variations to the present disclosure without departing from the spirit and scope of the present disclosure. Thus, if these modifications and variations of the present disclosure belong to the scope defined by the claims of the present disclosure and equivalents thereof, the present disclosure is also intended to include these modifications and variations.

What is claimed is:

1. An apparatus for adjusting the luminance of a screen of a spliced display device, the apparatus comprising:

an adjustment module configured to control rotation of a light-emitting unit within a backlight module in the spliced display device within a range;

a collection module configured to collect a plurality of pieces of luminance information of a spliced screen of the spliced display device when the light-emitting unit is rotated at various angles; and a processing module configured to calculate a ratio between a minimum luminance value and a maximum luminance value for each piece of the luminance information, determine a maximum value among a plurality of the ratios and a specific angle of rotation of the light-emitting unit corresponding to the luminance information having the maximum value, and rotate the light-emitting unit at the specific angle of rotation by controlling the adjustment module.

2. The apparatus according to claim 1, wherein the collection module is a camera.

3. The apparatus according to claim 2, wherein the camera is a charge-coupled device (CCD) camera or an infrared camera.

4. The apparatus according to claim 2, wherein an angle between an optical axis of the camera and the spliced screen ranges from −60 degrees to 60 degrees.

5. The apparatus according to claim 1, wherein the processing module comprises:

a calculating module configured to calculate a ratio between a minimum luminance value and a maximum luminance value for each piece of the luminance information, determine the maximum value among a plurality of the ratios and a specific angle of rotation of the light-emitting unit corresponding to the luminance information having the maximum value, and output a signal for the specific angle of rotation; and a controlling module in communication with the calculating module and configured to control the adjustment module to rotate the light-emitting unit at the specific angle of rotation according to the received signal for the specific angle of rotation.

6. The apparatus according to claim 1, wherein the adjustment module comprises:

a stepper motor in communication with the processing module; and a moving unit connected with the stepper motor in a mechanical transmission way.

7. The apparatus according to claim 6, wherein the moving unit is a mechanical arm.

8. The apparatus according to claim 1, wherein the light-emitting unit comprises a plurality of light emitting diode (LED) light bars located on each side of the spliced screen.

9. The apparatus according to claim 8, wherein the backlight module further comprises a frame for mounting the plurality of LED light bars;

wherein the frame has a fixed surface for mounting the plurality of LED light bars; and wherein the angle of rotation of the light-emitting unit is an angle of the light bars with respect to the fixed surface on which the light bars are located.

10. The apparatus according to claim 9, wherein each of the LED light bars is pivotally mounted onto the fixed surface by a rotary shaft.

11. A method for adjusting the luminance of a screen of a spliced display device which comprises a backlight module, the method comprising:

controlling rotation of a light-emitting unit within a backlight module in the spliced display device within a range;

collecting a plurality of pieces of luminance information of a spliced screen of the spliced display device when the light-emitting unit is rotated at various angles; and calculating a ratio between a minimum luminance value and a maximum luminance value for each piece of the luminance information, determining a maximum value among a plurality of the ratios and a specific angle of rotation of the light-emitting unit corresponding to the luminance information having the maximum value, and rotating the light-emitting unit at the specific angle of rotation.

12. The method of claim 11, wherein the luminance information of the spliced screen is collected by a camera.

13. The method according to claim 12, wherein the camera is a charge-coupled device (CCD) camera or an infrared camera.

14. The method according to claim 12, wherein an angle between an optical axis of the camera and the spliced screen ranges from −60 degrees to 60 degrees.

15. The method according to claim 11, wherein the calculating step comprises:

calculating a ratio between a minimum luminance value and a maximum luminance value for each piece of the luminance information, determining the maximum value among a plurality of the ratios and a specific angle of rotation of the light-emitting unit corresponding to the luminance information having the maximum value, and outputting a signal for the specific angle of rotation; and rotating the light-emitting unit at the specific angle of rotation according to the received signal for the specific angle of rotation.

16. The method according to claim 11, wherein the controlling step comprises:

controlling, by a stepper motor and a moving unit connected with the stepper motor in a mechanical transmission way, the light-emitting unit within the backlight module in the spliced display device to rotate within the range.

17. The method according to claim 16, wherein the controlling step comprises:

controlling, by the stepper motor and a mechanical arm connected with the stepper motor in a mechanical transmission way, the light-emitting unit within the backlight module in the spliced display device to rotate within the range.

18. The method according to claim 11, wherein the light-emitting unit comprises a plurality of light emitting diode (LED) light bars located on each side of the spliced screen.

19. The method according to claim 18, wherein the backlight module further comprises a frame for mounting the plurality of LED light bars;

wherein the frame has a fixed surface for mounting the plurality of LED light bars; and wherein the angle of rotation of the light-emitting unit is an angle of the light bars with respect to the fixed surface on which the light bars are located.

20. The method according to claim 19, wherein each of the LED light bars is pivotally mounted onto the fixed surface by a rotary shaft.

* * * * *